US005983758A

United States Patent [19]

Tanner

[11] Patent Number: 5,983,758

[45] Date of Patent: Nov. 16, 1999

[54] BOX WRENCH AND SOCKET WRENCH HAVING STOPPER PORTIONS FOR PREVENTING SLIPPAGE ALONG A NUT OR A BOLT HEAD

[76] Inventor: William Russell Tanner, Rte. 1, Box 455, Reva, Va. 22735

[21] Appl. No.: 08/909,624

[22] Filed: Aug. 12, 1997

[51] Int. Cl.[6] ..... B25B 13/00

[52] U.S. Cl. ..... 81/124.3; 81/124.6; 81/121.1; 81/186

[58] Field of Search ..... 81/121.1, 124.3, 81/124.4, 124.6, 124.7, 125, 186

[56] References Cited

U.S. PATENT DOCUMENTS

| | | | |
|---|---|---|---|
| 2,697,371 | 12/1954 | Bowman . | |
| 2,751,802 | 6/1956 | Reuillard . | |
| 2,774,259 | 12/1956 | Caulkins . | |
| 3,604,106 | 9/1971 | Borries . | |
| 5,255,578 | 10/1993 | Liou . | |
| 5,307,713 | 5/1994 | White . | |
| 5,782,148 | 7/1998 | Kerkhoven | 81/186 X |

FOREIGN PATENT DOCUMENTS

| | | |
|---|---|---|
| 1257487 | 7/1989 | Canada . |
| 2946777 | 5/1981 | Germany . |
| 130890 | 6/1948 | Sweden . |

*Primary Examiner*—James G. Smith

*Attorney, Agent, or Firm*—McGuire, Woods, Battle and Boothe LLP

[57] ABSTRACT

A wrench for rotating a fastener having a number of corners on a periphery thereof and method of making same is disclosed. The wrench includes a gripping member having an opening defined by an inner surface complimentary to the periphery of the fastener whereby the fastener may be axially received by the gripping member. The inner surface defines the plurality of circumferentially spaced shoulder portions wherein alternating shoulder portions engage a corresponding corner of the fastener. The shoulder portions define areas therebetween. Stopper portions are located in alternating areas between shoulder portions. The wrench has a first angular position where the stopper portions engage in upper surface of the fastener for restricting the passage of the fastener therethrough and a second angular position where the stopper portions do not engage the upper surface of the fastener thereby permitting the passage of the fastener therethrough.

11 Claims, 3 Drawing Sheets

BOX WRENCH AND SOCKET WRENCH HAVING STOPPER PORTIONS FOR PREVENTING SLIPPAGE ALONG A NUT OR A BOLT HEAD

FIELD OF THE INVENTION

The present invention relates generally to wrenches, and more particularly, to multi-point box-end wrenches and socket wrenches which are provided with stopper portions for restricting the passage of a fastener through the wrench.

BACKGROUND OF THE INVENTION

Multi-point box-end wrenches are well known in the art. The advantage of multi-point box-end wrenches is that these types of wrenches permit fasteners to pass clearly through. The disadvantage of such wrenches is that the retention of the box-end wrench upon a fastener is relatively difficult particularly when the box-end wrench is used in restricted locations where the fastener is not easily viewed when the user is attempting to rotate the wrench and fastener.

In an effort to overcome this deficiency there have been numerous attempts to provide a wrench structure that prevents the wrench head from slipping off or past the fastener with the subsequent risk of personal injury and/or damage to both the wrench and fastener as well as the consumption of the necessary time when using the wrench. See, for example, Canadian patent no. 1,257,487 and U.S. Pat. Nos. 2,774,259, 3,604,106 and 5,307,713.

The drawback of such structures is that although the wrench prevents the fastener from slipping through, there are situations in which it would be desirable to allow the fastener to pass therethrough. For example, when tightening two nuts together it may be necessary to have the wrench pass over the first fastener onto the second fastener. This is not possible using the structures disclosed in the aforementioned patents.

Other structures used for preventing the passage of a fastener there through incorporate the use of a single fixed projection or other type of structure for restricting passage of the fastener therethrough. See for example, Swedish patent no. 130,890 and U.S. Pat. No. 5,255,578. The drawbacks of these structures when engaged with the fasteners, is that the wrench has a tendency to cock and not properly engage the fastener.

Other structures have been proposed using a moveable projection for restricting the passage of the fastener therethrough. (See U.S. Pat. Nos. 2,697,371 and 2,751,802.) The disadvantage of such structures is that the movable portion is awkward to use.

SUMMARY OF THE INVENTION

It is, therefore, an object of this invention to provide a wrench in which the passage of the fastener therethrough can be restricted yet which also permits the passage of the fastener therethrough.

It is further object of the invention to provide a wrench which is economical to manufacture and easy to use.

These and other objects of the present invention are achieved by providing a wrench for rotating a fastener having a number of corners on a periphery thereof. The wrench includes a gripping member having an opening defined by an inner surface complimentary to the periphery of the fastener wherein the fastener may be axially received by the gripping member. The inner surface defines a plurality of circumferentially spaced shoulder portions where in alternating shoulder portions engage a corresponding corner of the fastener, and define areas therebetween. Stopper portions are located in alternating areas between shoulder portions. The wrench has a first angular position where the stopper portions engage an upper surface of the fastener for restricting the passage of the fastener therethrough and a second angular position where the stopper portions do not engage the upper surface of the fastener thereby permitting the passage of the fastener therethrough.

These objects are also achieved by providing a method of manufacturing a wrench. The method includes forming a gripping member having an opening defined by an inner surface which defines a plurality of circumferentially spaced shoulder portions wherein alternating shoulder portions engage corners of a fastener. The shoulder areas define areas there between. Stopper portions are formed which are located in alternating areas between the shoulder portions.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF THE DRAWINGS

For a more complete understanding of the present invention and advantages thereof, reference is now made to the following description taken in conjunction with the accompanying drawings in which like reference numbers indicate like features and wherein.

DETAILED DESCRIPTION OF THE INVENTION

Figure 1A:
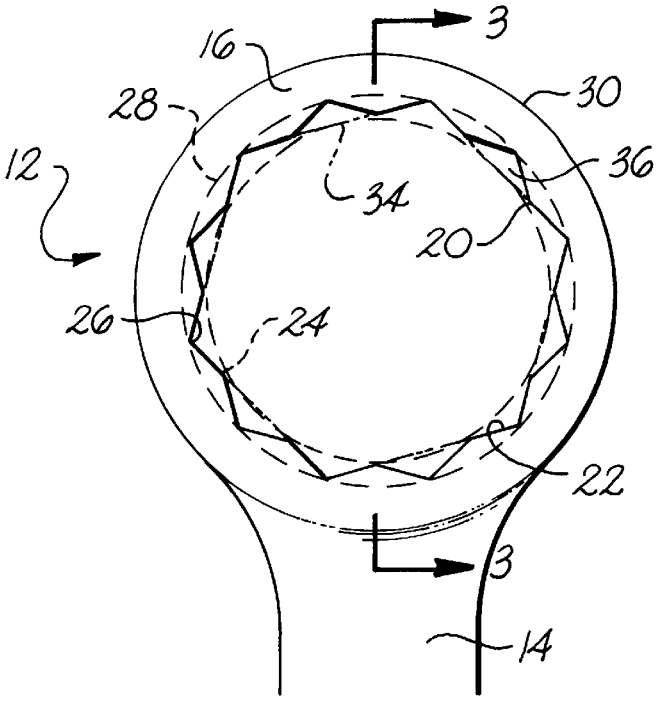
FIG. 1 is a top plan view of a box-end wrench according to the present invention.
Figure 1B:
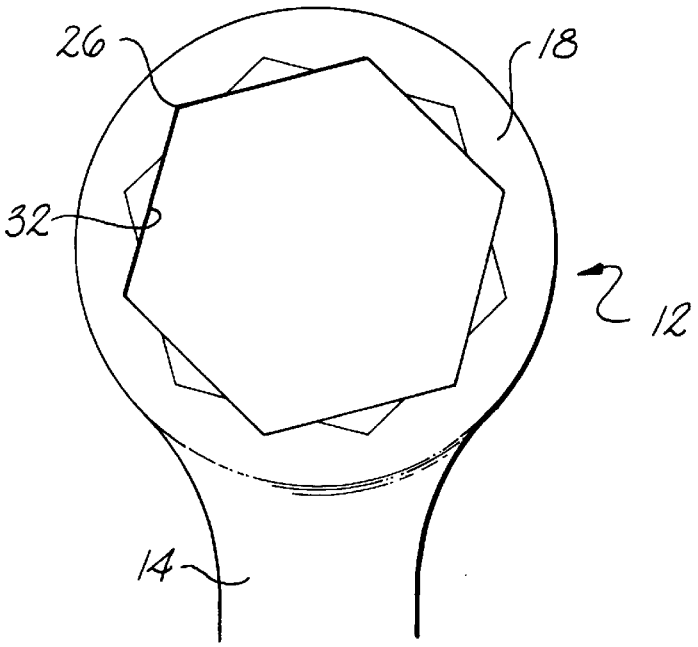
Figure 2:
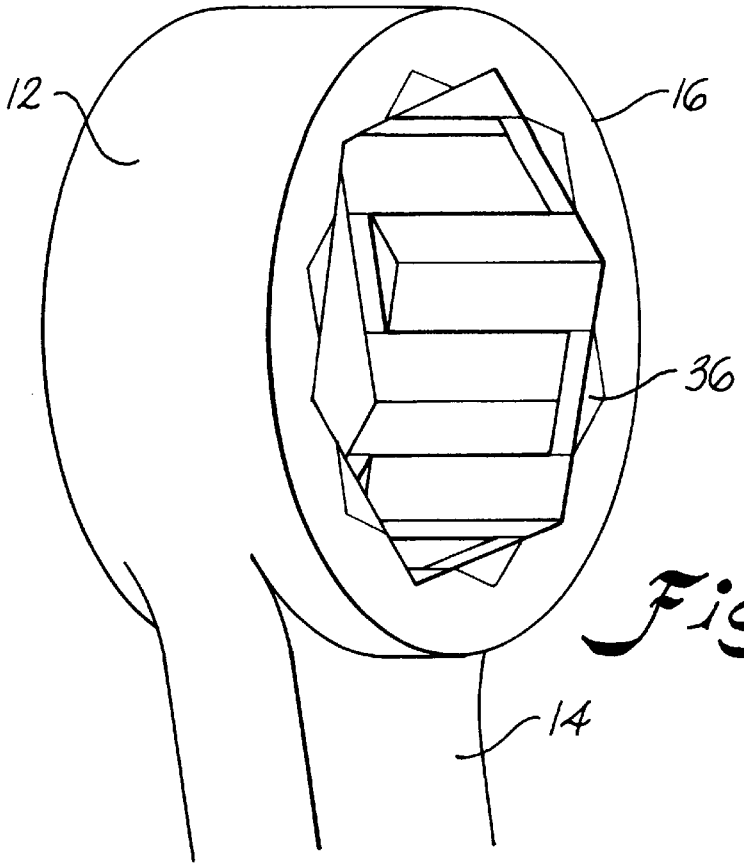
FIG. 2 is an isometric view of the box-end wrench of FIG. 1.

Referring first to FIGS. 1*a* and 2 a box-end wrench 10 is depicted which is constructed in accordance with the principles of the present invention. Box-end wrench 10 is usable with conventional hexagonal fasteners or bolts having six corners. As depicted in FIGS. 1*a* and 1*b* wrench 10 includes a head portion 12 formed integrally on one end of a handle 14. Handle 14 is preferably off set or angled towards one side thereof as depicted in FIG. 2. Head portion 12 has an upper surface 16 and a lower surface 18.

Figure 3:
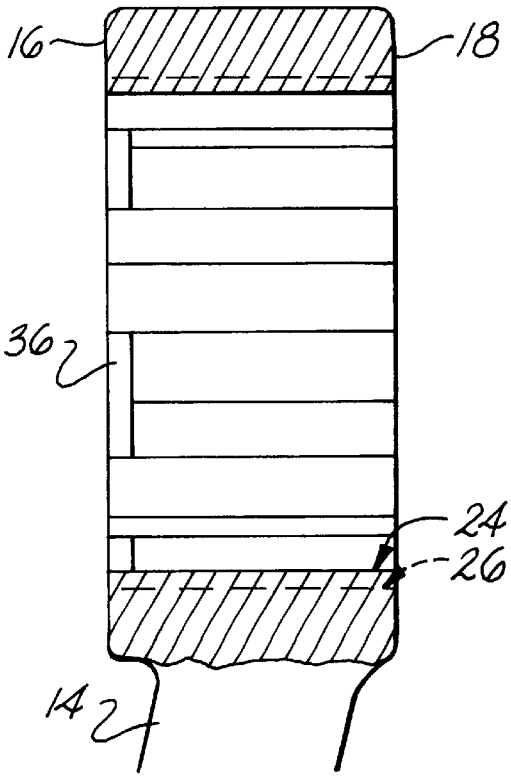
FIG. 3 is a cross-sectional view taken along line 3—3 of FIG. 1.

Inner points 20 are conventionally formed by broaching circumferentially spaced angulated portions 22 with a conventional broaching device. Inner points 20 lie on an inner circumference 24 (FIG. 3) at the juncture of two angulated portions 22. Outer points 26 are formed by broaching and lie on an outer circumference 28 (FIG. 3) formed at the junction of two angulated portions 22. As depicted in FIGS. 1–3, a 12 point box-end wrench is depicted having 24 angulated portions 22. Two angulated portions 22 forming an inner point 20 define a shoulder portion 30. Two coplanar angulated portions 22 form an imaginary chord 32 therebetween. Two adjacent shoulder portions define triangular areas 34 therebetween.

As depicted in FIG. 1*a,* integral stopper portions 36 are located in alternating triangular areas 34 between shoulder portions 30 near surface 18. The stopper portions 36 can be formed by conventional broaching techniques, forging or by welding. Stopper portions 36 are spaced sixty degrees apart. Stopper portions 36 act as support structures when the wrench 10 is used upon a nut or bolt head by stopping the axial movement of the wrench 10 in one direction. Stopper portions 36 are positioned so as to permit full axial engagement of wrench head 10 with a fastener.

Based upon a 12 point wrench, wrench head 12 will contain six stopper portions 36 positioned in alternating triangular areas 34. Stopper portions 36 do not extend beyond chords 32 so as to not interfere with a fastener when the fastener is rotated to another position. Stopper portion 36 may substantially fill a triangular area 34 but extends only for a portion of the axial length of the wrench 10.

In operation, wrench 10 has a first angular position where the stopper portions 36 engage in upper surface of a fastener for restricting the passage of the fastener therethrough. By rotating wrench 10 thirty degrees in either a clockwise or counterclockwise direction a second angular position is reached where the stopper portions 36 do not engage with the upper surface of the fastener thereby permitting the passage of the fastener therethrough. Advantageously, wrench 10 can easily be manipulated to engage the fastener and prevent the wrench 10 from slipping off or past the fastener, or if desired, the wrench 10 can easily be manipulated so that the wrench allows the fastener to pass therethrough.

Figure 5:
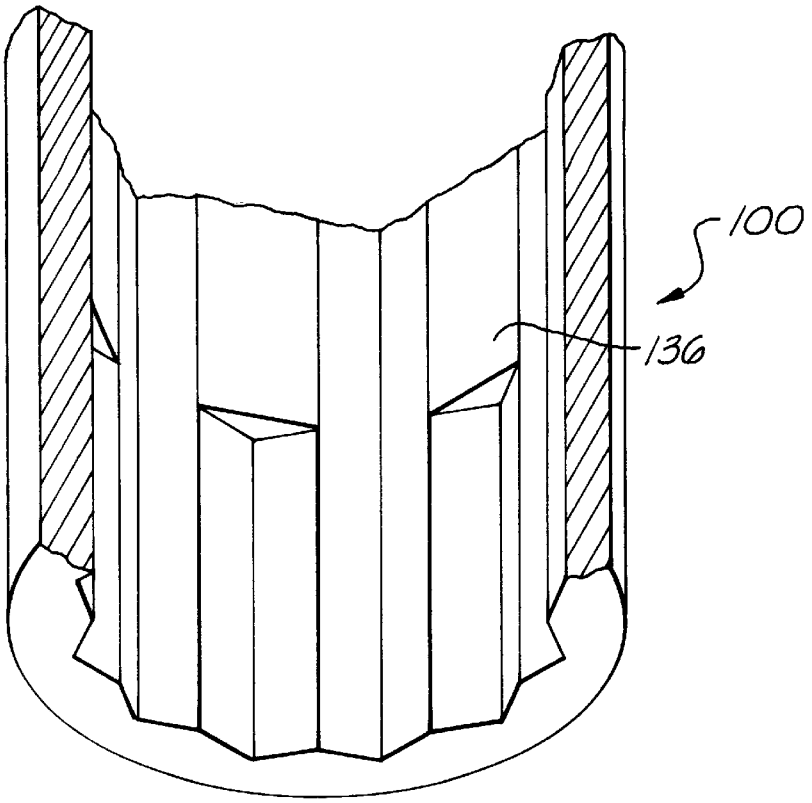
FIG. 5 is a cross-sectional view of the socket wrench of FIG. 4.
Figure 4:
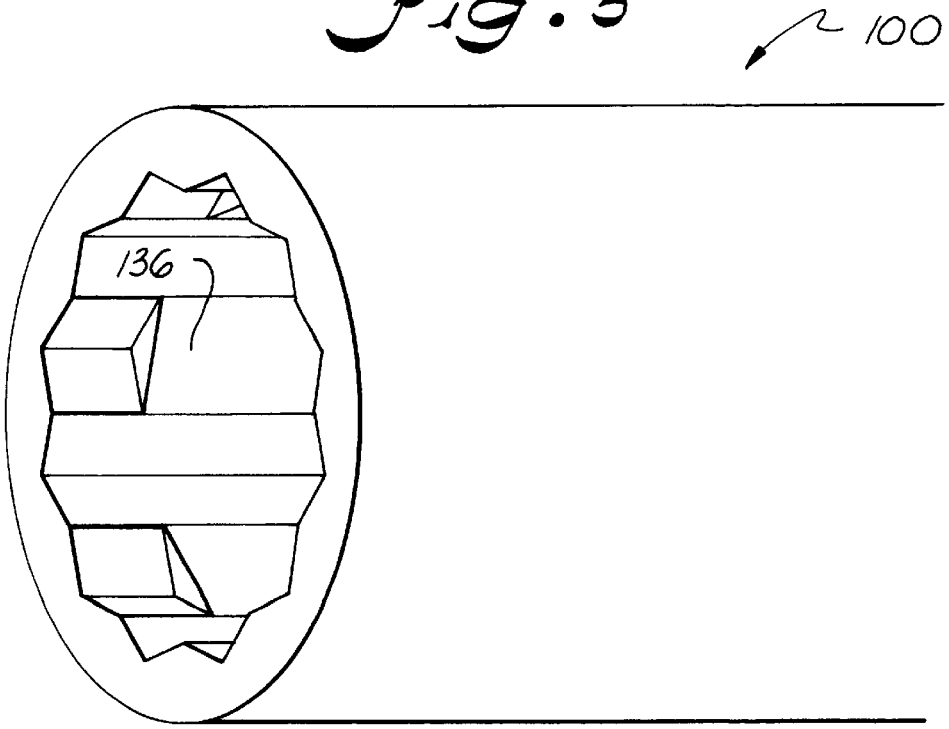
FIG. 4 is an isometric view of a socket wrench according to the present invention.

Referring to FIGS. 4 and 5, a socket wrench 100 is depicted which is similar in all regards to the box-end wrench 10 in structure except that the stopper portions 136 are spaced a vertical distance from a lower surface of the socket so as to enable an ordinary bolt or nut to fit therein. Socket wrench 100 is preferably a 12 point deep well socket.

It should be understood that the present invention is not limited to 12 point wrenches but is usable with any wrench having an even number of points.

It will be readily seen by one skilled in the art that the present invention fulfills all the objects set forth above. After reading the foregoing specification, one of ordinary skill will be able to effect various changes, substitution of equivalents and various other aspects of the invention as broadly disclosed herein. It is therefore intended that the protection granted hereon be limited only by the definition contained in the appended claims any equivalents thereof.

What is claimed is:

1. A box end wrench for rotating a fastener having a plurality of corners formed on a periphery thereof, said wrench comprising:

a gripping member having an opening defined by an inner surface complementary to the periphery of the fastener whereby the fastener may be axially received by said gripping member;

said inner surface defining a plurality of circumferentially spaced shoulder portions wherein alternating shoulder portions engage a corresponding corner of the fastener, said shoulder portions defining channels therebetween; and stopper portions disposed in alternating channels between said shoulder portions, thereby acting to block alternating channels while adjacent alternating channels remain unobstructed;

wherein said wrench has a first angular position wherein said stopper portions engage an upper surface of the fastener for preventing the passage of the fastener therethrough and a second angular position wherein the fastener passes freely through said unobstructed channels and outwardly beyond said gripping member.

2. The wrench of claim 1 wherein said wrench is a 12 point closed box end wrench.

3. The wrench of claim 1, wherein said inner surface is defined by a plurality of alternatively situated outer and inner points with wall portions therebetween, said inner points lying on an inner circumference and said outer points lying on an outer circumference and defining a triangular area between two adjacent said inner points and an outer point.

4. The wrench of claim 3, wherein each of said stopper portions substantially fills one of said triangular areas.

5. The wrench of claim 1, wherein said gripping member has a top and a bottom surface, each of said stopper portions being located adjacent one of said top and bottom surfaces.

6. The wrench of claim 3, wherein chords are defined by two of said wall portion with two of said wall portions therebetween.

7. The wrench of claim 6, wherein said stopper portions do not extend beyond said chords.

8. The wrench of claim 1, wherein said gripping member is configured for receipt of a hexagonal fastener.

9. The wrench of claim 1, wherein said stopper portions are symmetrically circumferentially spaced.

10. The wrench of claim 1, wherein said stopper portions are integral with said gripping member.

11. The wrench of claim 1, wherein said wrench includes an even number of said shoulder portions.

* * * * *

UNITED STATES PATENT AND TRADEMARK OFFICE

CERTIFICATE OF CORRECTION

PATENT NO. : 5,983,758
DATED : November 16, 1999
INVENTOR(S) : William R. TANNER It is certified that error appears in the above-identified patent and that said Letters Patent is hereby corrected as shown below:

On the title page: Item [54] and Column 1, line 3, should read

BOX WRENCH HAVING STOPPER PORTIONS FOR PREVENTING SLIPPING ALONG A NUT OR A BOLT HEAD --

Signed and Sealed this

Twelfth Day of September, 2000

*Attest:*

Q. TODD DICKINSON

*Attesting Officer*

*Director of Patents and Trademarks*